United States Patent [19]

Fredrixon

[11] Patent Number: 4,794,761

[45] Date of Patent: Jan. 3, 1989

[54] TOP STRUCTURE FOR COLD OR FREEZE TRANSPORT CONTAINER

[76] Inventor: Benny Fredrixon, S-103 91 Lidingö, Sweden

[21] Appl. No.: 83,817

[22] Filed: Aug. 11, 1987

[51] Int. Cl.[4] ..... F17C 7/02

[52] U.S. Cl. ..... 62/50; 62/388; 62/457

[58] Field of Search ..... 62/457, 388, 384, 385, 62/371, 373, 387, 52, 50

[56] References Cited

U.S. PATENT DOCUMENTS

| | | | |
|---|---|---|---|
| 1,832,473 | 11/1931 | Payson et al. | 62/388 |
| 1,864,040 | 6/1932 | Campbell | 62/388 |
| 1,865,155 | 6/1932 | Wetmore | 62/388 |
| 1,980,089 | 11/1934 | Rice, Jr. | 62/388 X |
| 2,065,985 | 12/1936 | Rice, Jr. | 62/387 X |
| 2,143,213 | 1/1939 | Reichle | 62/388 X |
| 2,677,245 | 5/1954 | Edmondson | 62/387 X |
| 3,213,641 | 10/1965 | Agee | 62/384 X |
| 3,401,671 | 9/1968 | Axelrod et al. | 62/371 X |
| 3,561,226 | 2/1971 | Rubin | 62/388 X |
| 3,789,616 | 2/1974 | Davidge | 62/50 |
| 4,294,079 | 10/1981 | Benson | 62/457 X |
| 4,300,356 | 11/1981 | Notaro et al. | 62/457 X |
| 4,457,142 | 7/1984 | Bucher | 62/388 |
| 4,561,262 | 12/1985 | Fredrixon | 62/62 |

*Primary Examiner*—Lloyd L. King

*Attorney, Agent, or Firm*—Shapiro and Shapiro

[57] ABSTRACT

A top structure for closing the top of an insulated box like transport container and for cooling goods therein is formed as a block like unit of foamed or cellular plastic. The top structure has cavities for receiving an un-pressurized liquid cooling medium that evaporates to a gaseous state, and that emerges into the container to keep the contents thereof at a predetermined temperature. The cavities for the liquid cooling medium are formed directly in the foamed or cellular plastic and communicate via a liquid trap with output channels opening out at the underside of the block like unit. Filler openings are arranged to allow gravity filling of the cavities.

24 Claims, 3 Drawing Sheets

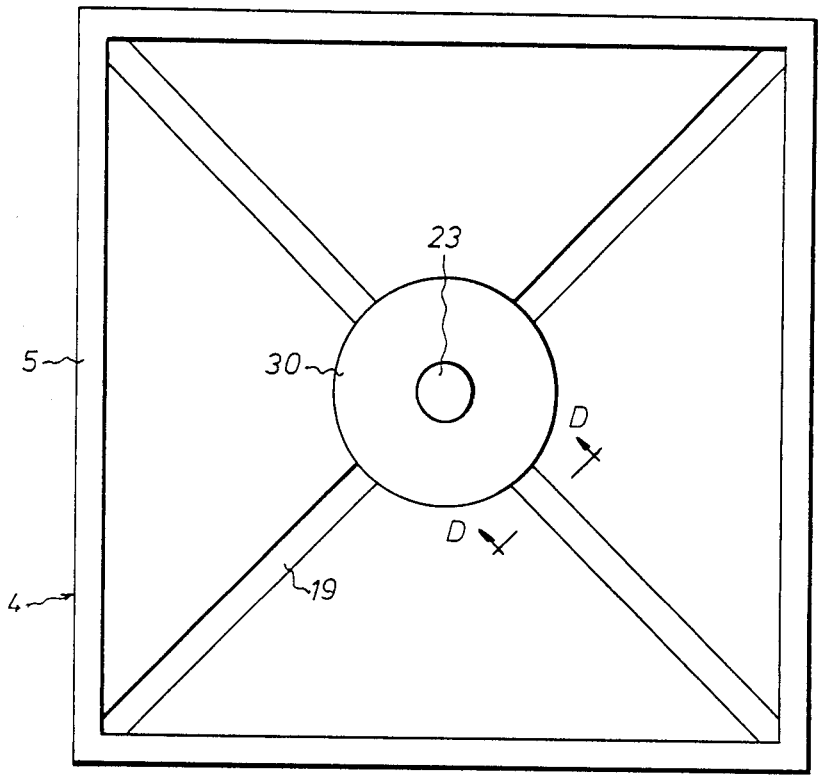
Fig. 3
Fig. 5
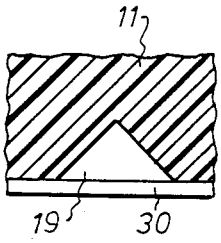

TOP STRUCTURE FOR COLD OR FREEZE TRANSPORT CONTAINER

The present invention relates to a top structure for a transport container primarily intended to be used for air freight of goods to be kept cold or frozen.

One general object of the invention is to provide a light weight container for one way use made from rather inexpensive material and in which goods in transit can be kept at or below a set temperature for a predetermined time.

The invention is partly based on the knowledge disclosed in my earlier U.S. Pat. No. 4,561,262 which teaches a container lid structure for shipping containers of ordinary cardboard or the like which is intended to keep the contents of such a container at a given temperature during transport. The known lid structure is primarily intended to be used for truck transport between wholesaler and retailer and for repeated use. The lids used are simply returned on next day's run. Return transport is of minor interest in air freight and the known lid is too expensive to be disposed of after use. Furthermore the known lid includes metal tanks, piping, nozzles et cetera, which makes it difficult to dispose of even if the cost could be minimized.

The idea behind the present invention is to use only cheap light weight material for the entire container, which material facilitates the production of the container, makes it sufficiently sturdy, gives it good heat insulating properties and facititates desctruction of the used containers without any environmental hazards.

The principal object of this invention is to provide an extremely simple yet reliable top structure for light weight insulated containers primarily for air freight purposes and arranged as a cooler unit.

Another object of this invention is to provide a top structure which is so inexpensive that it may be disposed of after use and which contains no material involving environmental hazards.

Liquid cooling medium such as nitrogen should not in its liquid state reach the goods to be cooled. Also, liquid should not escape from the storing spaces during handling of the container. To ensure this a further object of the invention is to provide a container top structure so arranged that only gas may emerge therefrom.

The new container and top structure include the combination of an insulated box like structure formed by a bottom and walls made from foamed plastic or the like and having a size adapted to the intended use; and an insulated top structure supported by an upper edge of the box structure also made of foamed plastic and adapted to be received inside the upper portion of the interior of the box like structure and to engage the inside border portion of the box walls. the top structure includes cavities formed in the foamed plastic and adapted to hold liquefied gas, a passage communicating with each cavity and with the interior of the box structure and a liquid trap, i.e. a flow controlling device, inserted in the passage to permit only coolant in the gaseous state to enter the interior of the box like structure.

A preferred embodiment of the transport container and top structure according to the invention will be described in detail below with reference to the accompanying drawings, wherein:

FIG. 3 is a bottom view of the top structure.

FIG. 5 is an enlarged cross section along line D—D of FIG. 3.

Figure 1:
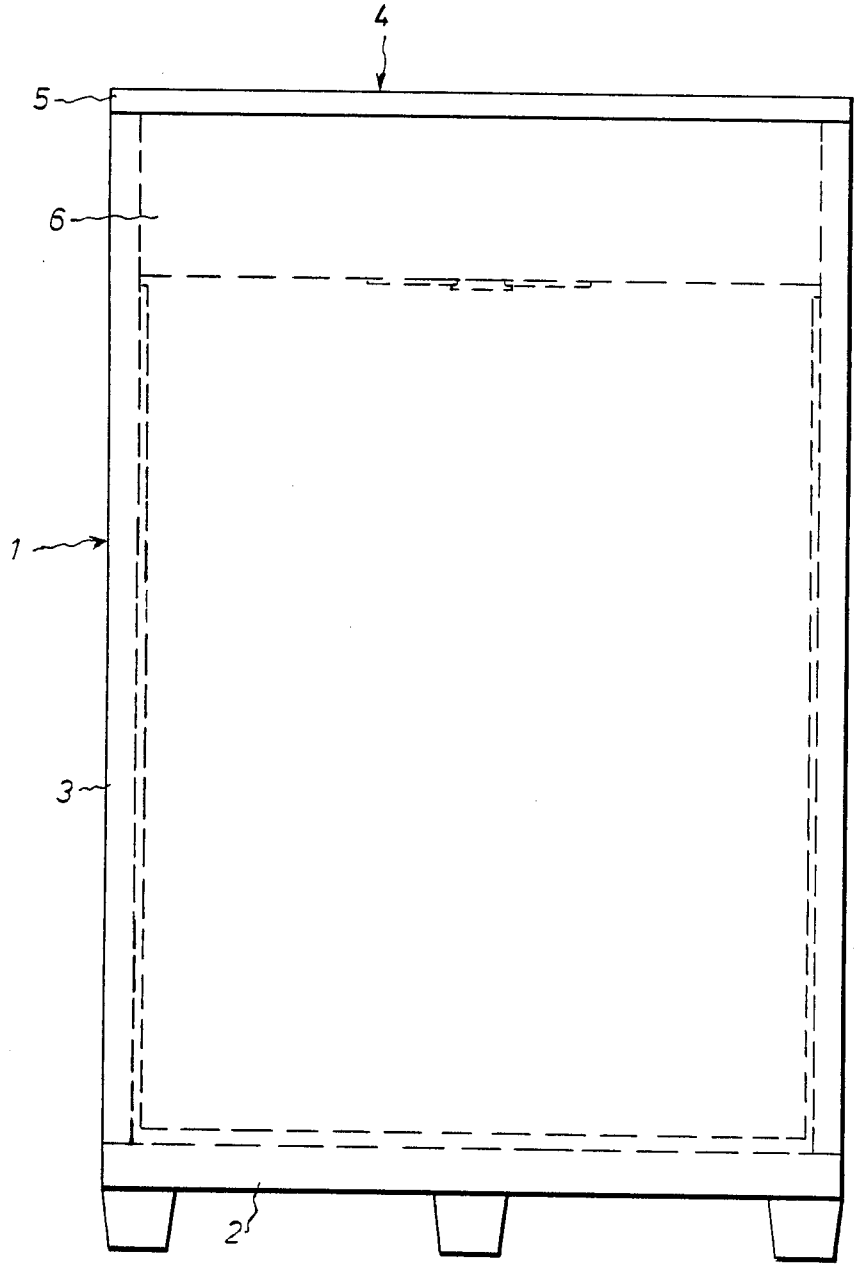
FIG. 1 is a schematic side view of an example of a transport container and top structure.
Figure 2:
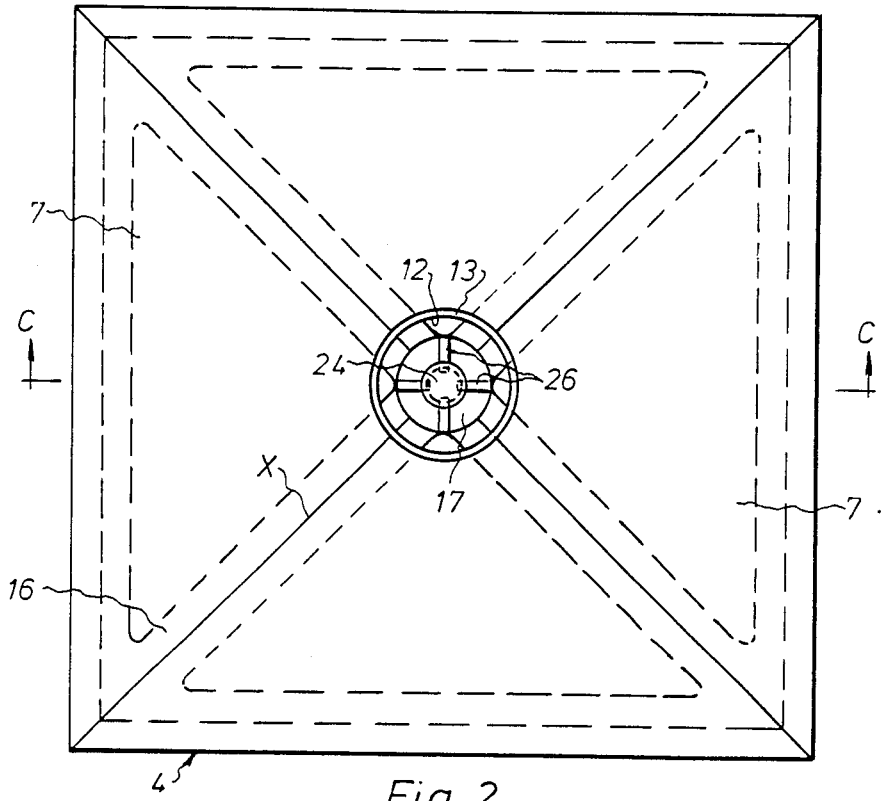
FIG. 2 is a top view of the top structure.
Figure 4:
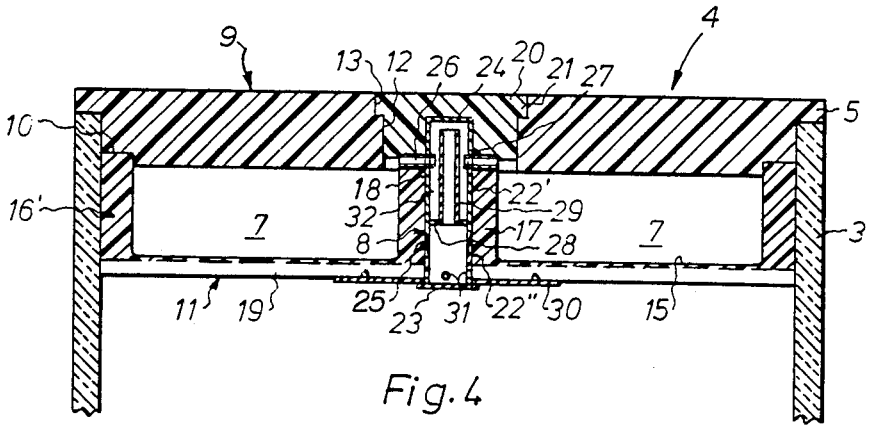
FIG. 4 is a cross section along line C—C in FIG. 2.

In the drawing, the box structure is generally designated 1 and said structure which is made of foamed or cellular plastic, preferably acrylonitrile-butadiene-styrene-plastic, includes a bottom 2 and side walls 3 or the like of self-supporting heat insulating material. The bottom or base 2 of the box structure can be a standard pallet of so called Euro-type entirely made of foamed plastic and the wall sections may be secured to the base in any suitable way. The box structure may also have a lining of cardboard, plastic sheet material or the like.

The top structure generally designated 4 is also made of foamed or cellular plastic such as acrylonitrile-butadiene-styrene plastic and is designed so it can be inserted into and be supported by the top end of the box structure. A protruding flange like projection 5 is intended to rest against the upper edge of the box structure walls 3. The top structure comprises a block like body 6 with a number of internal cavities 7 and a gas flow controlling device 8 at the centre thereof.

The block like body includes a top part 9 with parallel upper and lower sides. The outer edges are step-wise arranged to form the outer flange 5 intended to rest against the upper edge of the box structure walls 3 and a lower cut-out 10 intended to engage a lower part 11 as described below. At the center of the top part 9 there is a circular opening 12 having a cut out 13 at its upper end.

The lower part 11 of the body may be formed in one piece and may also—if sufficiently large forming machines are not available—be formed as four separate triangular pieces subsequently joined. Lines x indicate joints between four such pieces.

The lower part 11 has four triangular cavity forming recesses 15 separated by walls 16 and a hub-like centre portion 17. The upper edge of outer walls 16' of the lower part 11 is to engage the cut-out 10 of the top part 9, whereas the top sides of the recess separating walls 16 engage the lower side of the top part 9. The centre portion 17 has a bore 18, which extends through the lower part 11 to the underside thereof. The lower edge of the bore is bevelled and four V-shaped grooves 19 extend diagonally towards the outer corners of the underside.

From the inner corner of each of the recesses 15 to the bore 18 extends a U-shaped groove (not shown) each adapted to receive and position a pipe as described below.

A plug 20 having a peripheral flange 21 engaging the cut-out 13 at the upper end of the circular opening 12 of the top part 9 is insertable into said opening so as to meet the upper side of the hub like centre portion 17. Before the plug 20 is inserted the inner corners of each of the recesses or cavities are accessible through the circular opening 12.

The gas flow control device 8 includes an outer sleeve having bottom and top walls 23 and 24 respectively, the sleeve being formed by two separate pieces 22' and 22'' joined at a snap action V-joint 25; four radially oriented pipes 26 attached to the outer sleeve at holes 27 therein; an internal flange 28 attached to the inside of the sleeve below the holes and pipes 27 and 26; an inner sleeve 29 open at both ends and secured to the inner edge of the flange 28 and extending upwardly above the holes 27 of the outer sleeve but terminating remote from the outer sleeve top wall 24. The bottom wall 23 extends radially beyond the outside of the outer sleeve forming an abutment of a circular disc 30 and perforations 31 are made through the outer sleeve adjacent the botton wall thereof.

One piece of the gas flow control device 8 including the top end 22' of the outer sleeve with the pipes 26, the internal flange and inner sleeve 29 is inserted into the bore 18 from above, and the pipes 26 are received in the U-grooves at the top end of the hub like centre portion 17 of the lower cellular plactic block part. The other piece 22", upon which the disc 30 is slipped, is inserted into the bore 18 from below and the two pieces 22' and 22" are pressed together so that the snap joint secures them.

The top part 9 and the lower part 11 may be glued together. In case the lower part 11 consists of four separately formed pieces, also such pieces may be glued together. In the latter case lower part pieces are also mechanically held together by the pipes 26 engaging the top of each centre portion 17 and the disc 30 engaging the underside. Pins attached to the disc and pressing into the bottom material further ensure a good mechanical contact.

When the top structure is positioned on the container or box structure, the cavities 7 are filled to a predetermined level with liquid gas, e.g. liquid nitrogen through the inner corner portions of the cavities accessible through the central opening 12. The filling preferably is made with a four barrelled gravity funnel or mouthpiece. After filling, the plug 20 is inserted thereby sealing the cavities 7 from the exterior. Gas evaporating from the cavities now escapes through the pipes 26 into a chamber 32 defined by the inside of the outer sleeve 22', 22" the flange 28 and the inner sleeve 29 and from this chamber over the upper edge of the inner sleeve 29 downwardly through same and out via the perforations 31 to be radially channelled along the V-grooves 19 downwardly partly covered by the disc 30.

In case, due to movement of the aircraft or when handling the container un-gasified gas runs out through any of the pipes 26, such liquid is trapped in the chamber defined by the outer and the inner sleeve 22', 22" and 29 respectively and remains at the bottom portion of said chamber and evaporates gradually. Unevaporated gas, thus, cannot reach the interior of the container and cannot be spilled even if the top structure is removed.

The rate of evaporation is, as is well-known, determined by the thickness of the insulation, and the duration of the transport determines the volume of liquefied gas necessary. The simplicity of the construction using non-pressurized liquid gas makes it also possible to refill the cavities during the transport by removing the plug and pouring liquid into the cavities.

What I claim and desire to secure by Letters Patent is:

1. A top structure made as a block-like unit of foamed or cellular plastic for closing the top of an upwardly open transport container and for cooling goods contained in the transport container, said top structure having means for supporting the same at the top of said container in a position for closing the top of said container, internal cavity means formed directly in the foamed or cellular plastic for receiving an unpressurized liquid cooling medium that evaporates to a gaseous state, filling means including openings with removable plug means for filling said cavity means with liquid cooling medium, and liquid trap means connected by pipe means to the cavity means and communicating with permanently open output channel means for permitting cooling medium only in the gaseous state to flow downwardly into said container, said liquid trap means comprising outer upwardly closed sleeve means connected via permanently open pipe means to said cavity means, upwardly and downwardly open inner sleeve means, and flange means connecting a lower end of said inner sleeve means to an inside wall of said outer sleeve means, said pipe means opening to a trap chamber defined by said inner sleeve means, said flange means and said inside wall of said outer sleeve means below an upper end of said inner sleeve means, which upper end is spaced from a closed upper end of said outer sleeve means.

2. A top structure as claimed in claim 1, wherein said cavity means comprises a plurality of cavities.

3. A top structure as claimed in claim 1, which is rectangular and in which said cavity means includes triangular cavities defined by recesses in the plastic block-like unit and a corner portion of each cavity is located adjacent the center of said unit.

4. A top structure as claimed in claim 1, wherein the permanently open output channel means comprises downwardly open V-shaped grooves arranged at the bottom of said block-like unit and extending from the center of the said unit towards the edges thereof and a disc-like means at least partially covering said grooves from below, and wherein said disc-like means is attached to a lower end of said outer sleeve means, which end is downwardly closed but has radially directed perforations.

5. A top structure as claimed in claim 1, wherein said outer sleeve means comprises two axially connectible sleeve sections.

6. A top structure as claimed in claim 3, wherein said corner portion of each of said cavities opens to an upwardly open recess-forming cavity filling means, said plug means being insertable into said cavity filling means for closing the same.

7. A top structure comprising a container top, said container top including a thermally insulating top body having a plurality of cavities therein for containing a liquefied-gas cooling medium, outlet means for discharging cooling medium from the cavities to the interior of a container body on which the container top is received, and means connecting said cavities to said outlet means by way of a common liquid trap, said liquid trap having means for permitting the cooling medium to flow from the cavities to the outlet means in a gaseous state but not in a liquid state.

8. A top structure according to claim 7, wherein said top body is made of foamed or cellular plastic, with said cavities being formed directly in the plastic.

9. A top structure according to claim 7, wherein an upper portion of said top body has an opening aligned with parts of the respective cavities for filling the cavities with the cooling medium, said container top further including plug means insertable into said opening for closing the same.

10. A top structure according to claim 9, wherein said cavities are arranged about a central part of the top body, said liquid trap is disposed in said central part, and said opening is formed in said central part.

11. A top structure according to claim 10, wherein each cavity is triangular and has an open corner portion located beneath said opening.

12. A top structure according to claim 7, wherein said liquid trap comprises an outer sleeve having a closed upper end, an inner sleeve mounted within the outer sleeve so as to define a chamber between the two sleeves, the inner sleeve having an open upper end spaced from the upper end of said outer sleeve and an open lower end peripherally sealed to an inside wall of the outer sleeve and in communication with said outlet means, and wherein said cavities are connected by pipe means to said chamber at points intermediate the upper and lower ends of said inner sleeve.

13. A top structure comprising a container top, said container top including a top body made of foamed or cellular plastic having cavity means formed directly in the plastic for containing a liquefied-gas cooling medium, outlet means for discharging cooling medium from said cavity means to effect cooling of the interior of a container on which the container top is received, and means connecting said cavity means to said outlet means for conveying cooling medium from said cavity means to said outlet means, said connecting means including liquid trap means for allowing cooling medium to flow from said cavity means to said outlet means in a gaseous state but not in a liquid state.

14. A top structure according to claim 13, wherein said cavity means comprises a plurality of cavities each having an upwardly open portion disposed beneath a common filler opening in said top body, said container top further including plug means insertable into said filler opening for closing the same.

15. A top structure according to claim 14, wherein said upwardly open portions of said cavities are disposed adjacent to the center of said top body.

16. A top structure according to claim 13, wherein said liquid trap means comprises a liquid trap having a trap chamber defined by an inner sleeve and an outer sleeve, the inner sleeve having open upper and lower ends with its lower end peripherally sealed to an inside wall of said outer sleeve and in communication with said outlet means and with its upper end spaced from a closed upper end of said outer sleeve, said cavity means being connected by pipe means to said chamber intermediate the upper and lower ends of said inner sleeve.

17. A top structure according to claim 16, wherein said outer sleeve has a closed lower end with laterally directed perforations, and said outlet means comprises a plurality of downwardly open channels formed in the bottom of said top body in communication with said perforations and having downwardly open portions partially covered by covering means.

18. A container for transporting goods in cold storage, comprising a container body having a bottom wall and side walls projecting from the bottom wall, and a removable container top for closing the container body and cooling goods stored in the container body, said container top including a top body made of foamed or cellular plastic having a portion adapted to fit into the container body in peripheral engagement with the insides of said side walls and flange means for engaging said side walls to support said container top on said container body, said portion of said top body having cavity means formed therein for containing a liquefied-gas cooling medium, outlet means for discharging cooling medium from said cavity means to the interior of said container body when said container top is placed on said container body to close the same, and means connecting said cavity means to said outlet means for conveying cooling medium from said cavity means to said outlet means, said connecting means including liquid trap means from permitting cooling medium to flow from said cavity means to said outlet means in a gaseous state but not in a liquid state.

19. A container according to claim 18, wherein said container body is also formed of foamed or cellular plastic.

20. A container according to claim 18, wherein said cavity means comprises a plurality of cavities disposed about a central portion of said top body, said liquid trap means comprises a liquid trap mounted in said central portion, and said cavities are connected by respective pipe means to said liquid trap.

21. A container according to claim 20, wherein each cavity has a portion located adjacent to said central portion beneath a central filler opening formed in an upper portion of said top body.

22. A container according to claim 21, wherein said container top further includes plug means insertable in said filler opening for closing the same.

23. A container according to claim 20, wherein said liquid trap comprises an outer sleeve having a closed upper end, an inner sleeve disposed within said outer sleeve and having an open lower end peripherally sealed to an inside wall of said outer sleeve and an open upper end spaced from said upper end of said outer sleeve, said inner and outer sleeves defining a liquid trap chamber therebetween, said pipe means being connected to said trap chamber intermediate the upper and lower ends of said inner sleeve.

24. A container according to claim 23, wherein said outer sleeve has a closed lower end with laterally directed perforations, and said outlet means comprises a plurality of downwardly open channels formed in the bottom of said portion of said top body and extending laterally outwardly from said central portion, said channels being in communication with said perforations and having downwardly open portions partially covered by covering means.

* * * * *